US007959155B2

(12) United States Patent
Templeton et al.

(10) Patent No.: US 7,959,155 B2
(45) Date of Patent: Jun. 14, 2011

(54) PACKER CUP

(75) Inventors: Matthew Templeton, Calgary (CA); Brian Templeton, Calgary (CA)

(73) Assignee: Associated Research Developments Ltd., Calgary (CA)

( * ) Notice: Subject to any disclaimer, the term of this patent is extended or adjusted under 35 U.S.C. 154(b) by 630 days.

(21) Appl. No.: 12/068,152

(22) Filed: Feb. 4, 2008

(65) Prior Publication Data

US 2009/0194947 A1 Aug. 6, 2009

(51) Int. Cl.
*E21B 33/126* (2006.01)

(52) U.S. Cl. ..... 277/335; 166/202

(58) Field of Classification Search ..... 277/335, 277/439; 166/202
See application file for complete search history.

(56) References Cited

U.S. PATENT DOCUMENTS

| | | | | | |
|---|---|---|---|---|---|
| 2,069,212 | A | | 2/1937 | Buffington | 277/439 |
| 2,388,520 | A | | 11/1945 | Bowie | 277/439 |
| 2,852,323 | A | * | 9/1958 | Bowerman | 277/335 |
| 2,943,009 | A | * | 6/1960 | Mirsky et al. | 264/259 |
| 3,104,883 | A | * | 9/1963 | English et al. | 277/335 |
| 3,179,022 | A | * | 4/1965 | Bloudoff | 92/252 |
| 3,450,412 | A | | 6/1969 | Collett | |
| 3,765,647 | A | * | 10/1973 | Grove et al. | 251/317 |
| 4,081,185 | A | * | 3/1978 | Lane | 277/335 |
| 4,129,308 | A | | 12/1978 | Hutchison | |
| 4,149,566 | A | | 4/1979 | Stowe | |
| 4,317,408 | A | * | 3/1982 | Williams | 92/241 |
| 4,596,395 | A | * | 6/1986 | Miser | 277/562 |
| 4,751,870 | A | * | 6/1988 | Gramling | 92/209 |
| 5,028,056 | A | | 7/1991 | Bemis et al. | |
| 5,499,826 | A | | 3/1996 | Pippert et al. | 277/437 |
| 6,390,196 | B1 | | 5/2002 | Montaron et al. | 166/290 |
| 6,550,775 | B2 | * | 4/2003 | Knapp | 277/314 |
| 6,554,068 | B1 | | 4/2003 | Chatterji et al. | 166/285 |
| 6,668,938 | B2 | * | 12/2003 | Sheffield et al. | 166/387 |
| 7,469,905 | B2 | * | 12/2008 | Knapp | 277/608 |
| 7,731,884 | B2 | * | 6/2010 | Knapp et al. | 264/259 |
| 2003/0024386 | A1 | | 2/2003 | Burke | 92/240 |
| 2003/0098153 | A1 | * | 5/2003 | Serafin | 166/202 |
| 2005/0133218 | A1 | * | 6/2005 | Plomp | 166/202 |

* cited by examiner

*Primary Examiner* — Shane Bomar
*Assistant Examiner* — Blake Michener
(74) *Attorney, Agent, or Firm* — Welsh Flaxman & Gitler LLC

(57) ABSTRACT

A packer cup for sealing the interior of a pipe under pressure includes a first region of relatively soft material and a second region of relatively hard material. The region of the relatively softer material would begin at the lip of the cup and extend for at least one third the length of the cup up to the entire length of the cup.

12 Claims, 8 Drawing Sheets

LIP AREA COMPRISED OF BOTH SOFT AND HARD MATERIAL

LIP AREA COMPRISED OF BOTH SOFT AND HARD MATERIAL

PACKER CUP

FIELD OF THE INVENTION

The present invention is directed to a device for sealing the interior of a casing or pipe allowing pressure to be applied in the sealed off section of the casing. The present invention is used to seal formations when servicing wells or to pressure test tubing or piping.

BACKGROUND OF THE INVENTION

The present invention is an improvement over U.S. Pat. No. 7,261,153, issued to Plomp. Both the present invention as well as the Plomp patent are assigned to the same assignee and the Plomp patent is incorporated by reference.

It is known in the art to provide a bell-shaped resilient member to use as a seal to seal off a section of pipe so that the section can be tested with pressure. Such seals are normally constructed from reinforced elastomer and dimensioned so that when pressure is applied to the sealed off portion, the pressure causes the bell-shaped member to expand against the inner wall of the pipe and seal it. A mandrel is often used with such seal members.

Typically, such packer cups are made of an elastomer. It is necessary with relatively soft materials to reinforce the cup and often the reinforcing is metal embedded in the elastomer prior to vulcanization. Such cups are shown in published patent application U.S. 2003/0098153 and U.S. Pat. No. 3,450,412. In the latter patent, fingers of metal are provided which extend longitudinally in the sides of the cup. During use, the outer covering will often wear away exposing the metal reinforcement. In that case, movement of the cup within a well tube can bend the reinforcing material so that it snags within the tube, plugging it. In that case, it can be extremely expensive to open the pipe or tube, to retrieve the cup.

In U.S. Pat. No. 4,149,566 a test cup is provided which has a bell-shaped end, L-shaped metal-reinforcing ring segments embedded therein and an opposite tubular portion with an internal metal sleeve embedded therein. This patent describes a prior art cup constructed of an elastomer of two different hardnesses. It is described that the juncture between the two elastomers is a fault line and typically such a device fails along this line sooner than with other types of seals. It is also noted that the lower or belled end of the cup includes the softer of the two elastomers.

In U.S. Pat. No. 4,751,870 there is described a seal for oil and gas well swabs. The seals are primarily of rubber with a centrally located reinforcing tube of metal or plastic. In this patent however internal reinforcing ribs are provided to resist the tendency to expand under pressure against the walls of the pipe.

In U.S. Pat. No. 5,028,056 a composite material is described which is used to form a reinforced base for a pump piston. Resilient material is filled with reinforcing fibers to increase the stiffness of the seal.

In U.S. Pat. No. 4,129,308 the seal is mounted on a mandrel by a frangible backup ring. This assembly is intended to be broken up and left in the well hole and therefore does not include metal supports.

U.S. Pat. No. 7,261,153, issued to Plomp, also describes a packer cup for use in the sealing of the interior of a pipe under pressure. This packer cup, as particularly described in FIG. 3 includes a sleeve of an elastomeric material, such as polyurethane having two different densities and hardnesses. The top or lip portion of the sealing cup described in the Plomp patent is of a softer material so that it would expand under pressure to form a seal. A tubular bottom portion would be constructed from an elastomer which would be harder than the material of the top or lip portion. For example, the lip would have a density of approximately 1.07 and the tubular end of the sleeve would have a density of approximately 1.3. The hardness of the lip would be approximately 80-95 SHORE A and the hardness of the tubular end would be approximately 60 SHORE D. Furthermore, the cup could be provided with an optional sleeve, such as constructed from metal or molded in a polymer. The outer diameter of the bell-shaped portion would be slightly larger than the inner diameter of the pipe into which it is inserted, thereby allowing for a proper seal under pressure.

However, it has been found that the softer material at the top or lip of the packing cup does not abrade as quickly as the harder material at the bottom of the packing cup. Additionally, the interface between the softer material and harder material is prone to separation in some circumstances.

SUMMARY OF THE INVENTION

The present invention overcomes the disadvantages of the prior art by extending the soft material previously provided only at the top or lip of the packing cup for a longer length down the sides of the cup. This softer material would be more abrasion resistant thereby allowing the cup to last longer and fail less. This is of particular importance since these cups typically run through thousands of meters of casing, many times under high pressure which would cause the cups to wear down quickly without the utilization of this longer length of softer material, on a portion of the exterior surface of the cup.

Furthermore, the utilization of this softer material along a longer length of the cup would allow the cup to compress more easily which would be easier on the equipment and less prone to catch on the collars of the equipment. The casings would generally have a collar resulting in a groove upon which the harder material of the packing cup would jam. Consequently, the use of a packing cup having a longer length of softer material would prevent the cups from jamming on the collar grooves.

In addition, because of the larger area of contact between the softer and harder materials there is less likelihood of separation of the two materials.

Finally, the larger area of the soft material of the packing cup would provide a better seal.

Many modifications, variations and combinations of the method and systems of the present invention are possible in light of the description of the present invention. The description above and many other features and intended advantages of the present invention will become apparent from a consideration of the following detailed description when considered in conjunction with the accompanying drawings.

DETAILED DESCRIPTION OF THE PRESENT INVENTION

Figure 1:
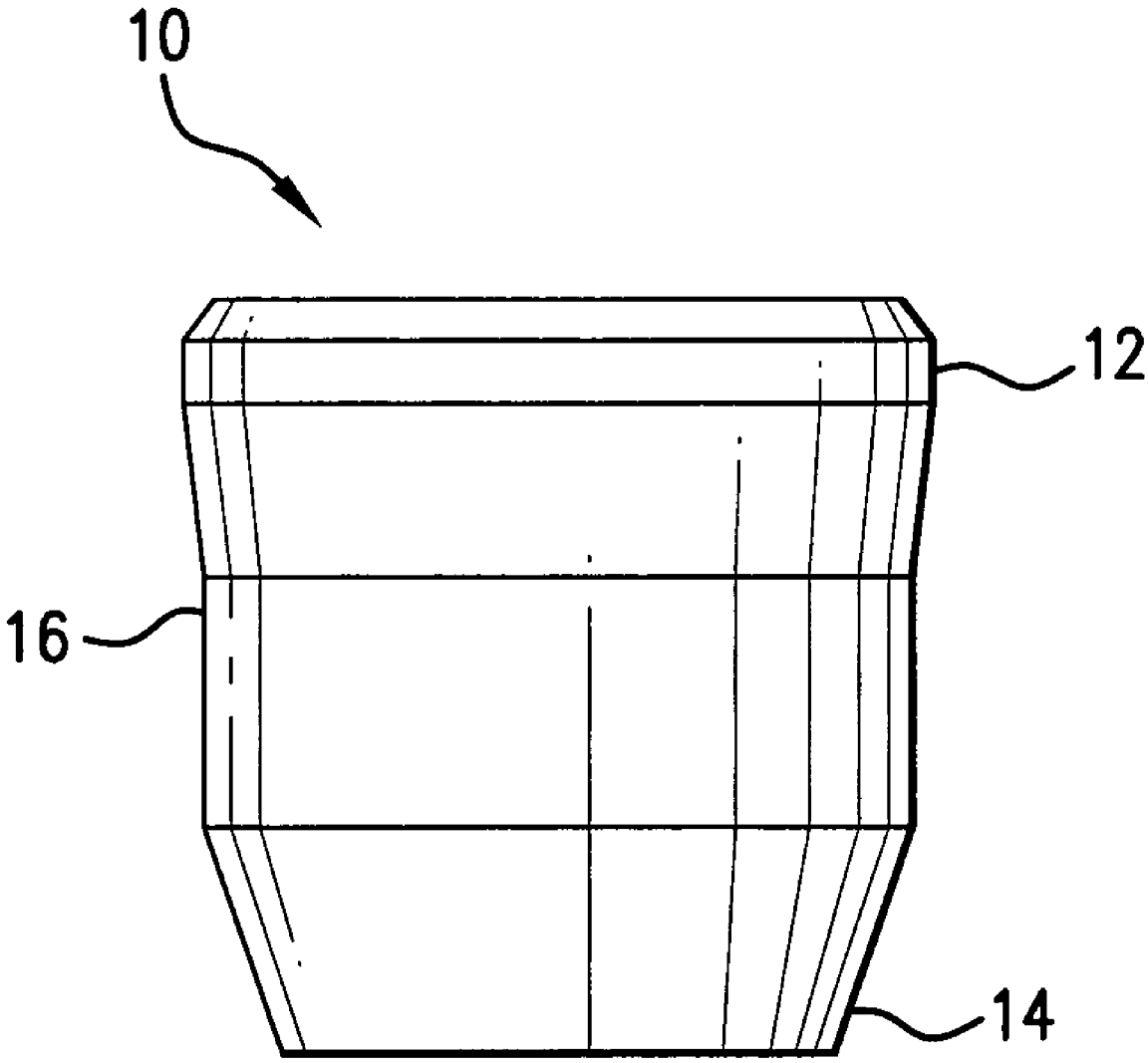
FIG. 1 is a side view of the packer cup of the present invention.

FIG. 1 illustrates a side view of the packing cup of the present invention as well as the packing cup described with respect to U.S. Pat. No. 7,261,153. Both packing cups 10 include a bell-shaped lip portion 12, an elongated sleeve 16 extending from the bell-shaped end 12 and a tubular end 14 provided at the end of the sleeve 16.

Figure 2:
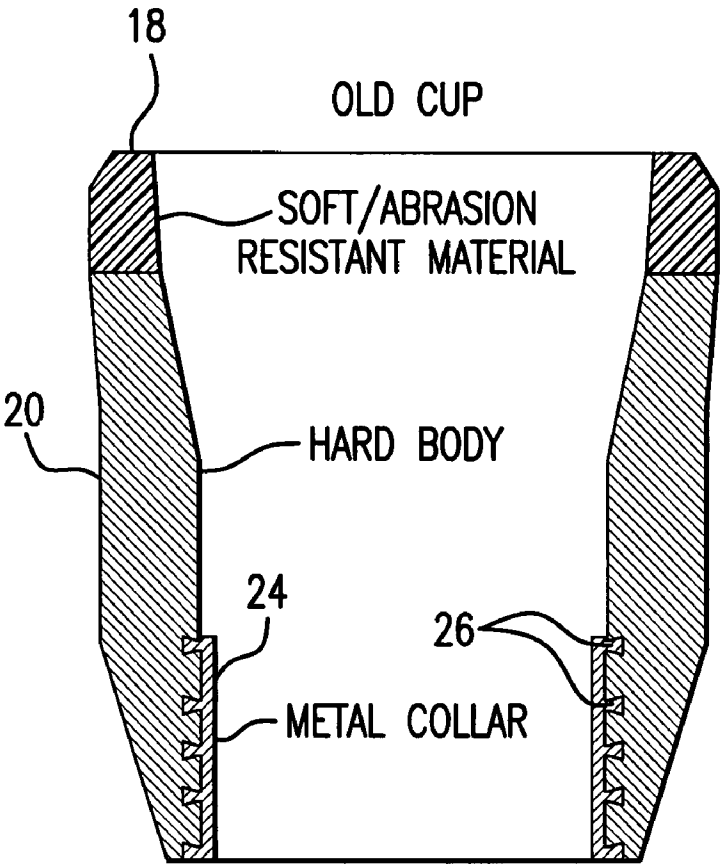
FIG.2 PRIOR ART
FIG. 2 is a cross-sectional view of the packer cup of FIG. 1 showing a prior art cup.

As illustrated with respect to FIG. 2, the lip section 12 of the prior art packing cup described in the Plomp patent was composed of a relatively soft/abrasion resistant material 18 of an elastomeric material, such as polyurethane. The lip 18 would have a density of about 1.07 and a hardness of approximately 80-95 SHORE A. The remainder of the packing cup would comprise a relatively hard/rigid body 20 having a density of approximately 1.3 and hardness of approximately 60 SHORE D. An optional metallic collar 24 was secured to the rigid body 20 by any means consistent with the operation of the present invention, such as by adhesive. As shown in FIG. 2, the collar 24 would be provided with a plurality of finger-like projections 26 cooperating with corresponding adjacent apertures provided in the hard/rigid body 20. It is noted that the use of the collar 24 was optional, and that this collar was generally constructed from steel, but could also be constructed from a polymer.

Figure 3:
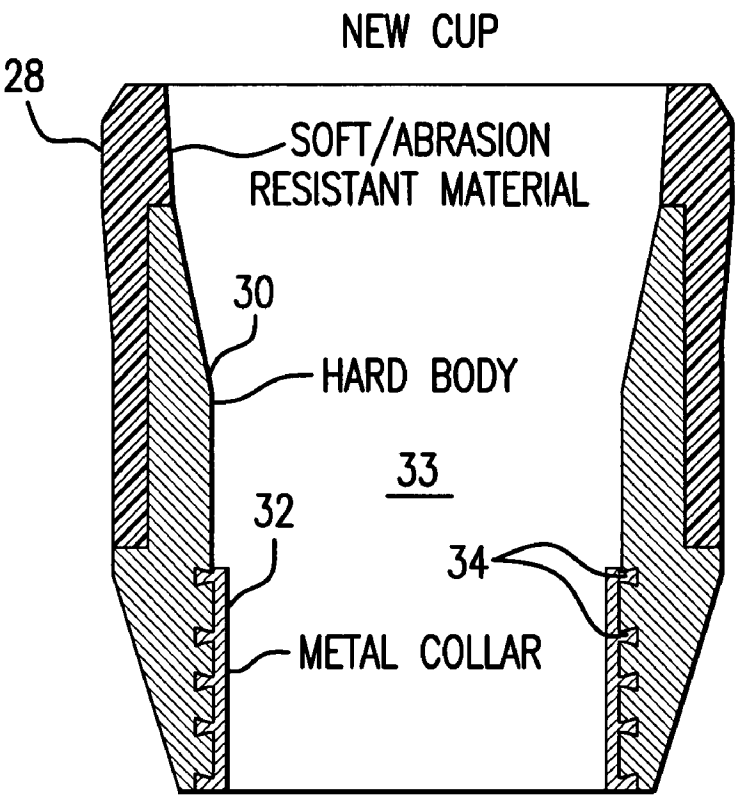
FIG. 3 is a cross-sectional view of the packer cup of FIG. 1 showing a first embodiment of the present invention.

A first embodiment of the packing cup of the present invention is illustrated with respect to FIG. 3. A soft/abrasion resistant material 28 similar with respect to the density and hardness of the soft/abrasion resistant material 18 would be provided in the bell-shaped end as well as extend for at least one third the length of the improved packer cup. The length of the cup could vary between three and six inches. Therefore, if the blank for the packer cup was 4.0", the soft/abrasion resistant material 28 would extend for at least 1.33" or, could extend for most of the entire length of the packer cup. Similar to the prior art packer cup, the packer cup of the present invention could include a collar 32 positively attached to the hard/rigid material 30 by adhesion of the two materials, mechanically by interlocking the materials together, or by the use of any other suitable means, such as an adhesive. Similarly, the collar 32 could include a plurality of fingers 34 inserted into various apertures in the hard/rigid body 30, and would be constructed from various metallic materials, such as steel, or from a polymer. Since the softer material extends for a greater length in the present invention than the softer material in the Plomp patent which is only limited to the lip 18, the contact between the softer or harder material is increased, thereby reducing the likelihood of separation between the two materials. The fingers could be dove-tailed as shown in FIG. 3, or straight edged as shown by 54 in FIG. 12, or any other designs.

Figure 4:
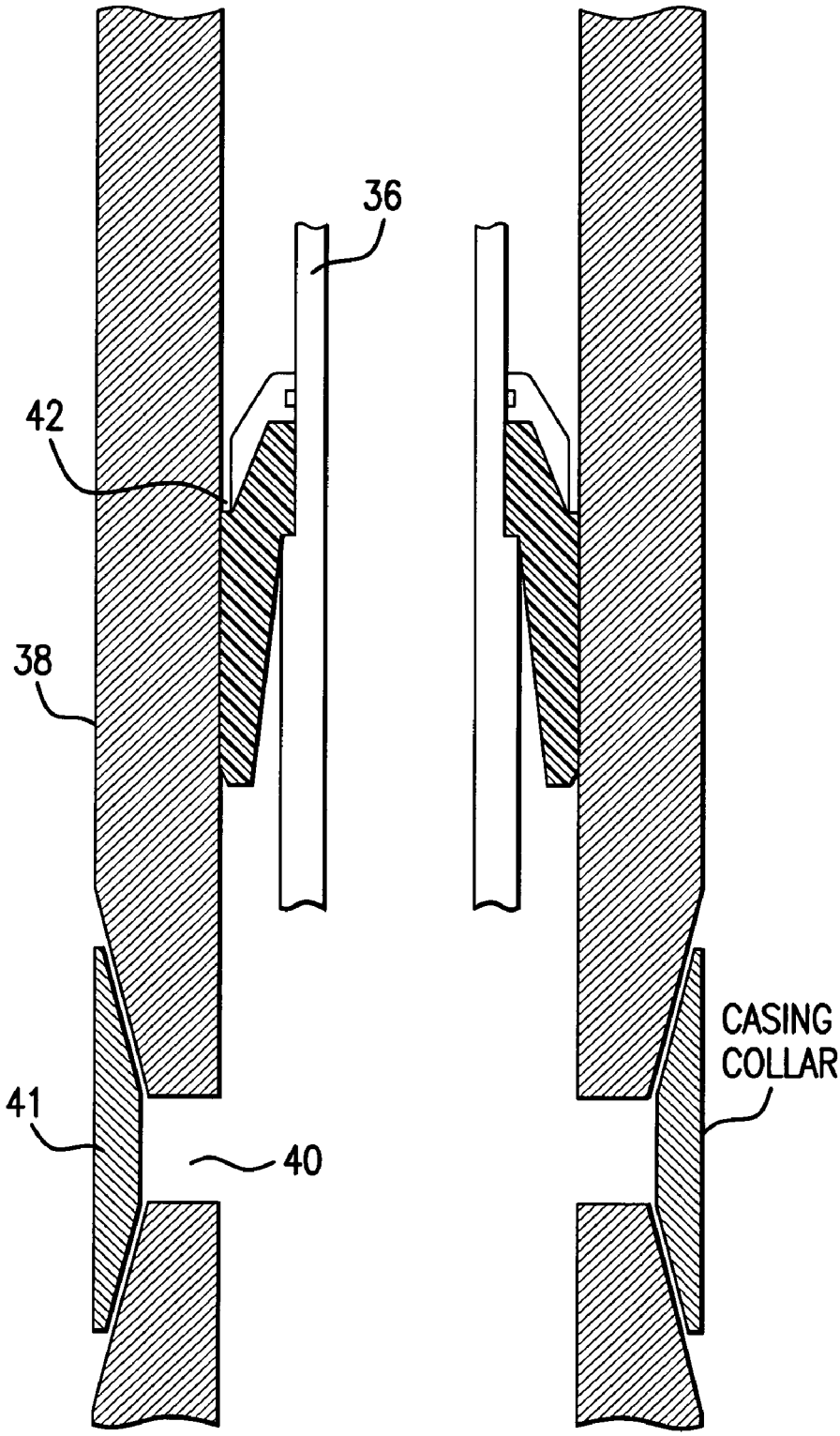
FIG. 4 is a view of the inflated packer cup of the present invention shown in a casing.

The packer cup of the present invention is designed to be utilized within a typical oil or gas casing 38. The packing cup would therefore be provided with a hollow sleeve 33 formed by a portion of this softer material 28 at the top portion of the cup and by a larger portion of the harder material 30, as shown in FIG. 3. A tube or pipe 36, as shown in FIG. 4, could be inserted into the sleeve 33. A typical casing would include a collar 40, which connects two pieces of pipe and which could often cause a jam when the prior art cups were utilized. The use of the softer material 28 as shown in FIG. 2 would mean that the cup would be less likely to be caught on the casing collar. Additionally, the larger surface area and length of the softer material 28 of the packer cup of the present invention would provide a better seal.

Figure 5:
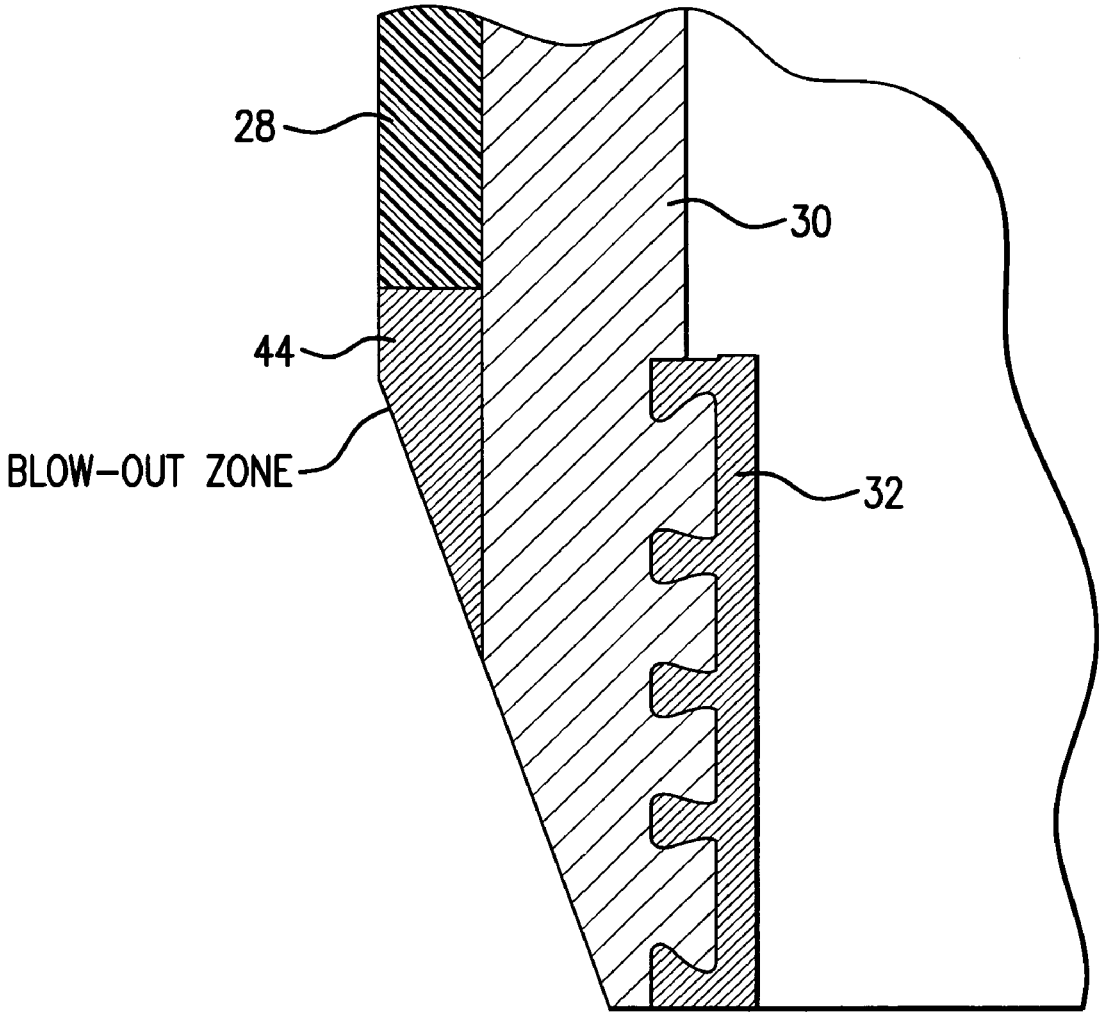
FIG. 5 shows a drawing of a blow out zone of the present invention.

As previously indicated, the softer material 28 may or may not run the length of the cup. This would leave an area of harder material 30 to provide an extra structure in the areas prone to failure. For example, as shown in FIG. 4, a small area 42 expands out between the casing 38 and the joint between the softer material 28 and of the harder material 30 of the cup. This area is usually the first to blow out. Therefore, as illustrated in FIG. 5, an additional area of hard material 44 similar in hardness and density to the hard material 30 would be utilized. FIG. 4 additionally shows the groove 40 of the casing collar 41. Due to the increased length of the softer material 28, it would be less likely that the cup would jam on the groove 40.

Figure 6:
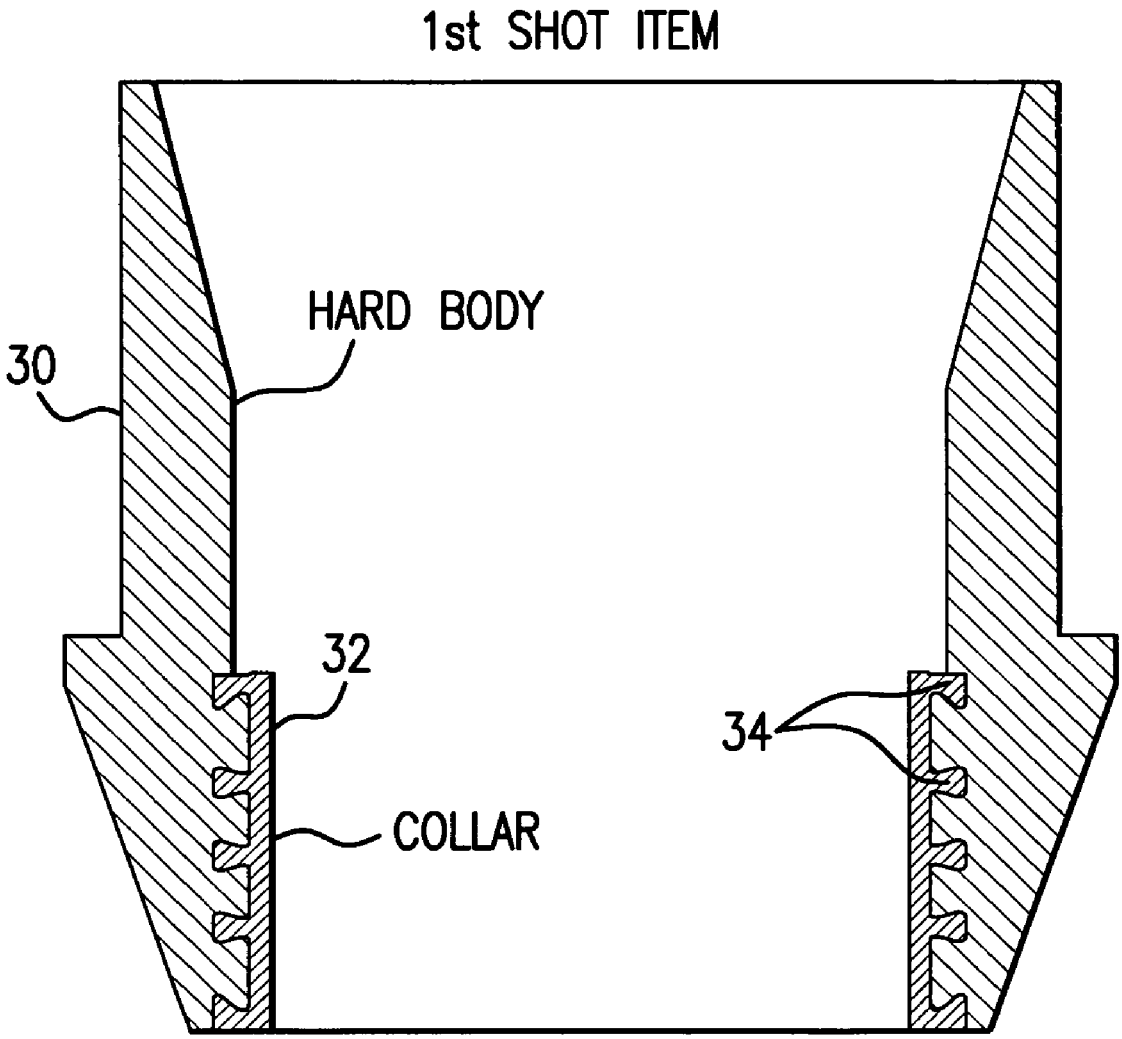
FIG. 6 is a view of the first embodiment provided in a first mold.

The present invention is designed to be manufactured by an injection molded process, although it could be hand poured. This is in contradistinction to the prior art design described in U.S. Pat. No. 7,261,153 in which the cup was only hand poured. The cup of the present invention would be manufactured in two stages designated "first shot" and "second shot". During the first shot, as shown in FIG. 6, the hard/rigid body 30 constituting a hard elastomeric material as well as the collar 32 would be manufactured. It is noted that the material of the collar could be a polymer, steel or any other similar material. It is also noted that the use of the collar 32 is optional. During the second shot, a portion of the cup shown in FIG. 6, with or without the metallic collar would be inserted into a different mold and the soft material such as a softer polyurethane would be added to produce the cup according to the present invention illustrated, for example, in FIG. 3. The injection molding process is preferable to the hand poured process in which the softer and harder materials would mix at their interface. Although this mixing could occur during the injection molding process, this is more a function of injection pressure or chemical bonding.

Figure 8:
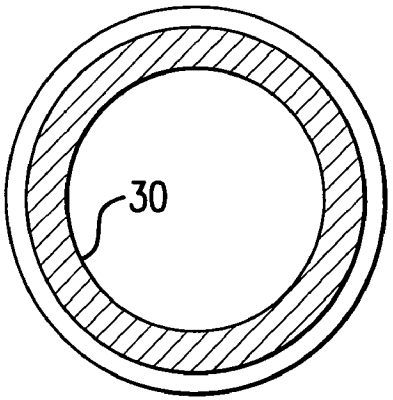
FIG. 8 is a top view of FIG. 7.
Figure 10:
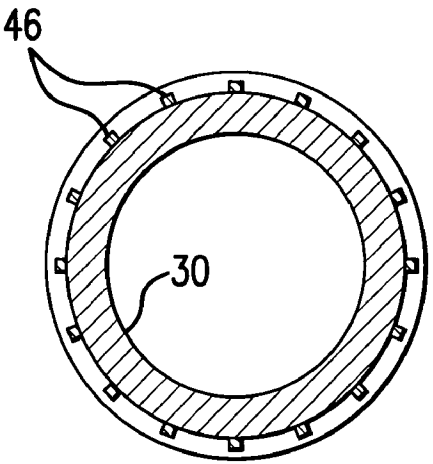
FIG. 10 is a top view of FIG. 9.
Figure 7:
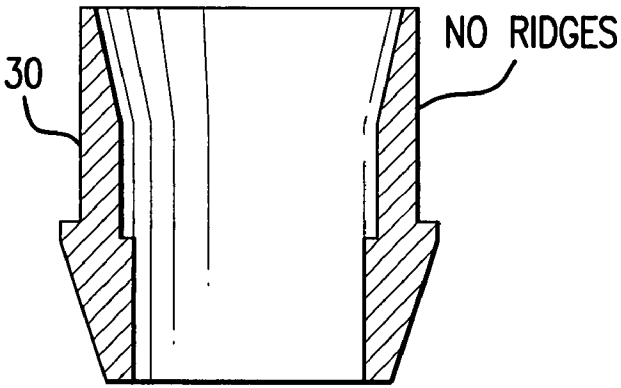
FIG. 7 shows a view of the present invention without any ridges.
Figure 9:
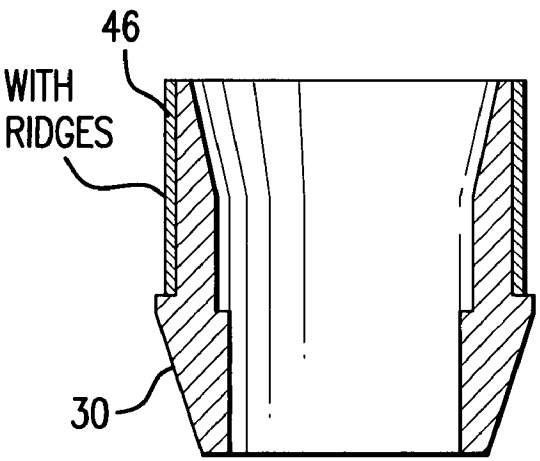
FIG. 9 is a view of the present invention utilizing ridges.

A plurality of ridges 46 can be included in the cup as illustrated with respect to FIGS. 9 and 10. Each of the ridges 46 would be of a length substantially equal to the length of the soft/abrasion resistant material 28. If provided within the packer cup of the present invention, these ridges would be produced in the first mold, and would generally be made of the harder material. FIGS. 7 and 8 illustrate the packer cup without the ridges. The use of the ridges on the outer diameter of the hard material would provide more surface area for bonding between the harder and softer materials.

Figure 11:
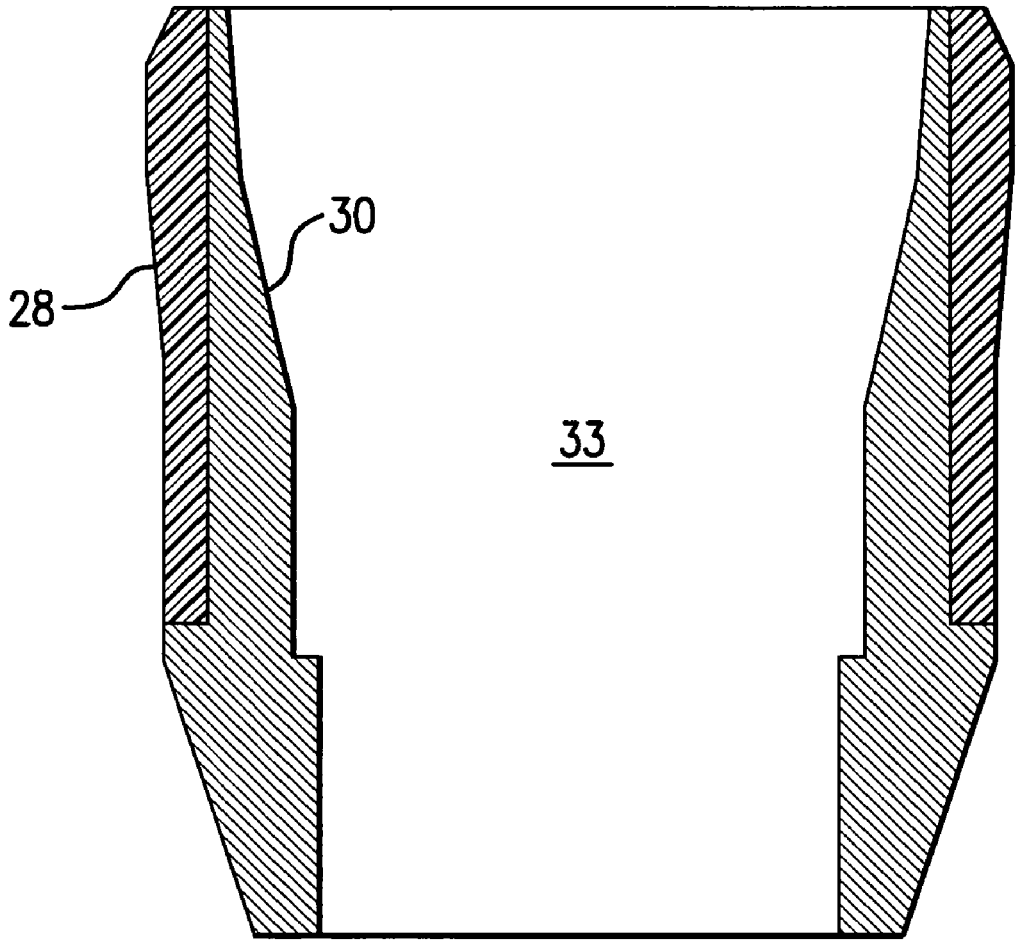
FIG. 11 is a view of a second embodiment of the present invention.

FIG. 11 illustrates a second embodiment of the present invention wherein the lip area includes both the softer material 28 as well as the harder material 30. In this embodiment, the inner surface of the sleeve 33 would only be constructed from the harder elastomer material.

Similar to the Plomp patent, the packer cup of the present invention could exhibit the same relationship of density and hardness of the softer material to the harder material. Therefore, the softer material 28 could have a density of approximately 1.07 and hardness of approximately 80-95 SHORE A, and the harder material 30 would have a density of approximately 1.3 and a hardness of approximately 60 SHORE D. However, it is noted that other parameters could be employed as long as the material 28 was softer than the material 31.

Figure 12:
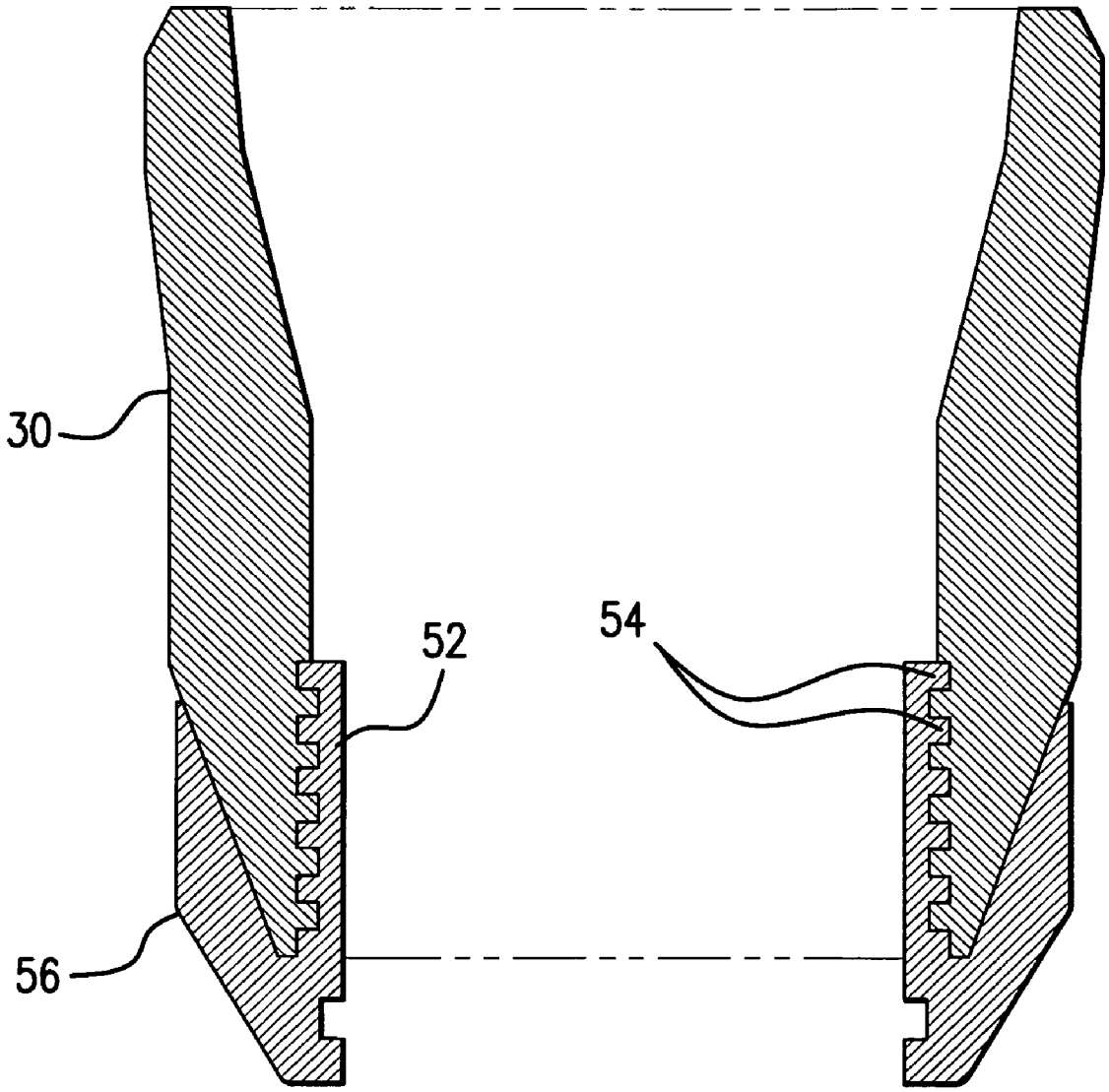
FIG. 12 is a view of an alternate embodiment provided in the first mold.

FIG. 12 describes the utilization of a cup retainer 56 when it is placed in the mold during a first shot as described with respect to FIG. 6. Generally, cup retainers are typically metal and serve the purposes of preventing a blowout in the lower portion of the cup as well as containing an O-ring or seal which seals against the mandrel of the mold onto which the cup is mounted. The present invention combines the retainer 56 with a collar 52 attached to the hard material 30. The collar 52 is shown to contain a plurality of straight edged fingers 54 inserted into corresponding pockets of the hard material 30. Alternatively, the fingers 54 could be dove tailed as shown in FIG. 6 or could be constructed in various other configurations. The embodiment shown in FIG. 12 would combine the retainer of the prior art with the collar 32. This would insure that the proper retainer is used, reduce the parts necessary for assembly of the complete tool as well as to reduce inventory requirements and field problems.

In summary then, a durable packer cup is described to seal an annulus within a pipe under pressure wherein the cup distorts to engage the internal surface of the pipe. In this way then, the pipe can be pressure tested or used to seal off formations when servicing wells. The cup of this invention has a softer lip at the bell-shaped end which is integral with the body of the cup itself.

While the preferred embodiment of the present invention has been illustrated and described, it would be appreciated that various changes can be made therein without departing from the spirit and scope of the invention. For example, although it has been indicated that different densities and hardness of polyurethane material can be utilized for the softer and harder portions of the cup, other types of elastomeric materials can be utilized. Additionally, although the present invention indicated a specific range of hardness and density, this range can be changed based upon the type of environment.

What is claimed is:

1. A packer cup having an inner surface and an outer surface for use in sealing an annulus between a pipe and a coaxially mounted tube, the cup adapted to surround the tube, comprising:

a hollow sleeve having first and second end openings, coaxially along the longitudinal axis of said sleeve, said first end opening having a bell-shaped portion and said second end opening having a tubular portion, said hollow sleeve having a portion constructed from a first elastomeric material having a first hardness and a second elastomeric material having a second hardness harder than said first elastomeric material, said first elastomeric material extending from said first end opening along the outer surface of said sleeve for a distance less than the distance between said first end opening and said second end opening, said second elastomeric material extending along the inner surface of said sleeve for the entire distance between said first end opening and said second end opening of said hollow sleeve.

2. The packer cup in accordance with claim 1, further including a collar secured to the inner surface of said hollow sleeve.

3. The packer cup in accordance with claim 2, wherein said collar is secured to said hollow sleeve in proximity with said second end opening.

4. The packer cup in accordance with claim 2, wherein said collar is metallic.

5. The packer cup in accordance with claim 2, wherein said collar is a polymer.

6. The packer cup in accordance with claim 1, further including a plurality of longitudinal ridges provided between said first elastomeric material and said second elastomeric material.

7. The packer cup in accordance with claim 1, wherein said first elastomeric material extends for at least one third the length of said hollow sleeve from said first end opening toward said second end opening.

8. A packer cup having an inner surface and an outer surface for use in sealing an annulus between a pipe and a coaxially mounted tube, the cup adapted to surround the tube, comprising:

a hollow sleeve having first and second end openings, coaxially along the longitudinal axis of said sleeve, said first end opening having a bell-shaped portion and said second end opening having a tubular portion, said hollow sleeve having a portion constructed from a first elastomeric material having a first hardness and a second elastomeric material having a second hardness harder than said first elastomeric material, said first elastomeric material extending along the outer surface of said sleeve for at least one third the length of said hollow sleeve from said first end opening toward said second end opening, said second elastomeric material extending along the inner surface of said sleeve and terminating at said second end opening; and a plurality of longitudinal ridges provided directly between said first elastomeric material and said second elastomeric material, the length of said longitudinal ridges substantially equal to the length of said longitudinal ridges substantially equal to the length of said first elastomeric material.

9. The packer cup in accordance with claim 8, further including a collar secured to the inner surface of said hollow sleeve.

10. The packer cup in accordance with claim 9, wherein said collar is secured to said hollow sleeve in proximity with said second end opening.

11. The packer cup in accordance with claim 9, wherein said collar is metallic.

12. The packer cup in accordance with claim 9, wherein said sleeve is a polymer.

* * * * *